US008720642B1

(12) United States Patent
Beckervordersandforth

(10) Patent No.: US 8,720,642 B1
(45) Date of Patent: May 13, 2014

(54) ACOUSTIC ELEMENT AND METHOD FOR PRODUCING AN ACOUSTIC ELEMENT

(71) Applicant: Wilfried Beckervordersandforth, Verl (DE)

(72) Inventor: Wilfried Beckervordersandforth, Verl (DE)

( * ) Notice: Subject to any disclaimer, the term of this patent is extended or adjusted under 35 U.S.C. 154(b) by 0 days.

(21) Appl. No.: 13/712,162

(22) Filed: Dec. 12, 2012

(51) Int. Cl.
*E04B 1/82* (2006.01)

(52) U.S. Cl.
USPC ..... 181/292; 181/290; 181/284; 244/1 N

(58) Field of Classification Search
USPC ..... 181/292, 284, 290; 244/1 N
See application file for complete search history.

(56) References Cited

U.S. PATENT DOCUMENTS

| | | | | |
|---|---|---|---|---|
| 1,554,179 | A | 9/1925 | Sewall | |
| 4,248,647 | A * | 2/1981 | Herron et al. | 156/84 |
| 4,340,129 | A * | 7/1982 | Salyers | 181/200 |
| 4,886,696 | A * | 12/1989 | Bainbridge | 428/184 |
| 6,290,022 | B1 * | 9/2001 | Wolf et al. | 181/292 |
| 6,977,109 | B1 * | 12/2005 | Wood | 428/131 |
| 7,600,609 | B2 * | 10/2009 | Nakamura | 181/290 |
| 8,100,226 | B2 * | 1/2012 | Cao et al. | 181/292 |
| 2002/0117352 | A1 * | 8/2002 | Veen et al. | 181/292 |
| 2010/0108438 | A1 * | 5/2010 | Duffy | 181/290 |
| 2013/0118831 | A1 * | 5/2013 | Kawai et al. | 181/290 |

FOREIGN PATENT DOCUMENTS

| | | |
|---|---|---|
| DE | 1014906 | 8/1957 |
| DE | 1876720 | 8/1963 |
| DE | 202006008302 | 8/2006 |
| DE | 102007040034 | 2/2009 |

OTHER PUBLICATIONS

International Search Report in European Application 10006480.7, EPO, Jan. 14, 2011.

* cited by examiner

*Primary Examiner* — Forrest M Phillips
(74) *Attorney, Agent, or Firm* — Bourque and Associates, PA

(57) ABSTRACT

An acoustic element has at least two board-shaped elements (1, 2). A dampening element (3), preferably a nonwoven element, is arranged between the two board-shaped elements (1, 2). The board-shaped elements (1, 2) exhibit bore holes (1*c*, 1*d*, 2*c*, 2*d*). The bore holes each exhibit a diameter of not more than 3 mm.

8 Claims, 7 Drawing Sheets

ACOUSTIC ELEMENT AND METHOD FOR PRODUCING AN ACOUSTIC ELEMENT

TECHNICAL FIELD

The invention relates to a board-shaped acoustic element for sound insulation in particular for use as a sound-absorbing panel element, for example, in interior design or when making furniture or as semi-finished products, for example, for the construction and furniture industries.

BACKGROUND INFORMATION

Board-shaped elements that are known from the prior art are designed such that sound waves are not reflected, but contained and absorbed. The sound-absorbing effect is achieved in that the acoustic elements exhibit recesses that allow for the sound waves to enter, whereby the sound energy is destroyed by a damped vibration of the air column in the recess.

It is known to provide these recesses as rectangular cut-outs, for example, with edge lengths in the range of 8 to 10 mm. It is also known to design the recesses as bore holes with diameters of more than 5 mm. Also, board-shaped acoustic elements are known, where webs are combined into a lattice structure and the, for example, square cut-outs are created by the meshes of the lattice structure. The dampening effect can be enhanced by applying a dampening element, for example, a nonwoven to the back side. The acoustic element is then installed such, that the dampening element, which due to its structure contributes to a stronger dampening of the vibrations of the air column in the recess, is mounted in a fashion not visible to the observer on the back of the acoustic element, i.e., for example, if the acoustic element is used as a ceiling tile on the invisible side of the acoustic element that faces the ceiling and faces away from the room.

The disadvantage of the described acoustic elements is that significant workability restrictions emerge due to the size of the recesses. For example, because of the recesses it is no longer possible to position screw connections arbitrarily on the surface of the board. Furthermore, it is no longer possible to make any arbitrary cuts to the board, in particular, for example, when building furniture, the cut edges are to be provided with corresponding facings, so-called edge bands. In practice, it is often necessary to manufacture such acoustic elements already with a view of the subsequent cutting measures, resulting in an increased logistical effort. Also, in practical applications it is often not possible to provide such acoustic elements with fittings, such as handles or hinges, or it may not be possible to provide in the desired form, or to process them in the same manner as solid boards.

SUMMARY

It is the object of the invention to specify an acoustic element and a method for producing an acoustic element, where the mentioned disadvantages do not occur or occur in a reduced manner.

The objective is solved by an acoustic element with the features of claims 1 and 2, as well as a method for the production of an acoustic element with the features of claim 8. The features of the dependent claims relate to advantageous embodiments.

According to the invention, this objective is achieved in that the recesses are designed as bore holes, which have a diameter of not more than 3 mm at least in the area of the surface of the acoustic element. According to the invention, at least two board-shaped elements can be assembled, which may be made of wood or wood replacement materials, for example, and exhibit such bore holes. Surprisingly, it became apparent that even small holes can provide sufficient dampening if a dampening element is arranged between the boards. Such dampening elements are known and available on the market and often referred to as acoustic nonwovens. These are nonwovens or similar thin mats, in particular made from fibrous materials that preferably have a thickness of a few tenths of a millimeter, for example, 2/10 mm, although in principle the thickness is not restricted, however using a thin dampening element of, for example, no more than 2/10 mm thickness is of advantage, because the mechanical properties of the board composite are at least largely similar to those of a solid board and are not or at least not significantly affected by the dampening element inserted between the board-shaped elements.

Alternatively or in addition to the installation of a dampening element, the holes of at least one of the board-shaped elements can be designed such that they each include sections with at least two different diameters. According to the invention, these are arranged such that a section with a smaller diameter, measuring preferably no more than 3 mm, points to the an outer surface of the acoustic element, while a section of the bore hole with a greater diameter points to the joining area of the two board-shaped elements. As a result, cavities are formed inside the acoustic element and increase the dampening effect, whereby in particular the acoustically effective area adjacent to the holes and thus its dampening effect is increased with the additional use of a dampening element.

Advantageously, the bore holes of various interconnected board-shaped elements run coaxial toward each other; however, production tolerances are permitted. It is sufficient in this respect that the holes of different interconnected board-shaped elements at least align with each other, i.e., apart from an interruption by a possibly existing dampening element, form a continuous channel through the acoustic element, because the cross sections of the two bore holes intersect at least partially at the joining area.

In principle, the outline of the holes in the depth direction, in particular the transitions from sections of different diameters can be designed freely. It is, however, advantageous to design the diameter transitions stepwise, whereby the step in the area of the diameter reduction or enlargement may also have the shape of a blunt conical surface, which is advantageous in practical application because of the drilling tools and their cutting geometries that are to be used for the production. Such transitions, which are characterized by the abrupt reduction of the bore diameter between two essentially cylindrical sections of different diameters, are hereinafter referred to as stepped holes.

In principle, the board-shaped elements can be connected in any desired manner. However, joining them by gluing or bonding is beneficial.

Acoustic elements of the inventive kind offer thus the advantage that they can be processed at least almost in the same manner as solid materials. It is especially possible to cut the acoustic elements and provide them with edge facings without regard for the holes, such that the acoustic elements can be supplied as board-shaped semi-finished products in standard sizes and can be shaped to any dimension and contour by the processor, for example, a cabinetmaker, with the continued possibility to attach fittings, for example handles and hinges, at any point of the acoustic element because screws in the sizes typical for furniture production will find sufficient support at any point of the surface of the acoustic element. Another particular advantage, resulting from the connection of a dampening element on the inside of the acoustic element with the bore hole diameters of not more than 3 mm, especially in the area of the surface of the acoustic element, is the fact that the acoustic element can be processed in any desired fashion on its surface, for example, without damaging the dampening element in this surface processing step, for example by spray mist when painting.

The inventive method for producing an acoustic element allows in particular for the manufacture of board-shaped elements with their inventive bore images in a simple manner. According to the invention it includes at least three essential steps. In the first processing step, at least two board-shaped elements are arranged as a composite. The arrangement is done such that at least one area intended as the surface of the acoustic element comes in contact with another board-shaped element. While the board-shaped elements are in this arrangement, the bore holes are generated in a second step. In a further processing step, the board-shaped elements are arranged in the order intended for the finished acoustic element, with at least one joining area of the previous arrangement becoming an outer surface in the arrangement intended for the finished acoustic element.

Preferably a dampening element can be arranged between two board-shaped elements or bonding or gluing can be performed, or the application of the adhesive or glue can be prepared prior to arranging the board-shaped elements in the arrangement intended for the finished acoustic element.

BRIEF DESCRIPTION OF THE DRAWINGS

These and other features and advantages of the present invention will be better understood by reading the following detailed description, taken together with the drawings wherein:

FIG. 1A shows a perspective presentation of the different layers of an exemplary acoustic element according to the invention;

DETAILED DESCRIPTION OF THE PREFERRED EMBODIMENTS

Figure 17:
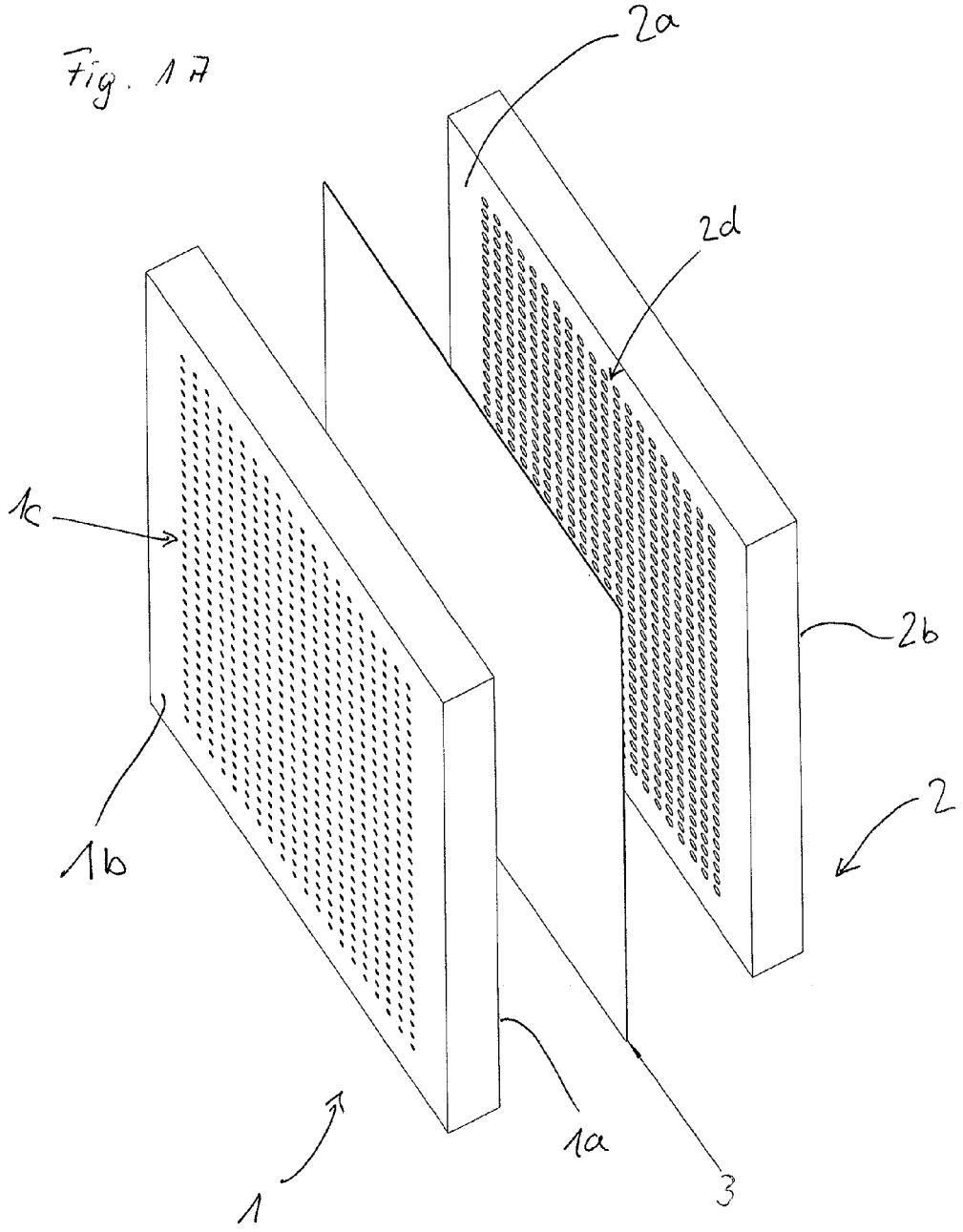
Figure 1B:
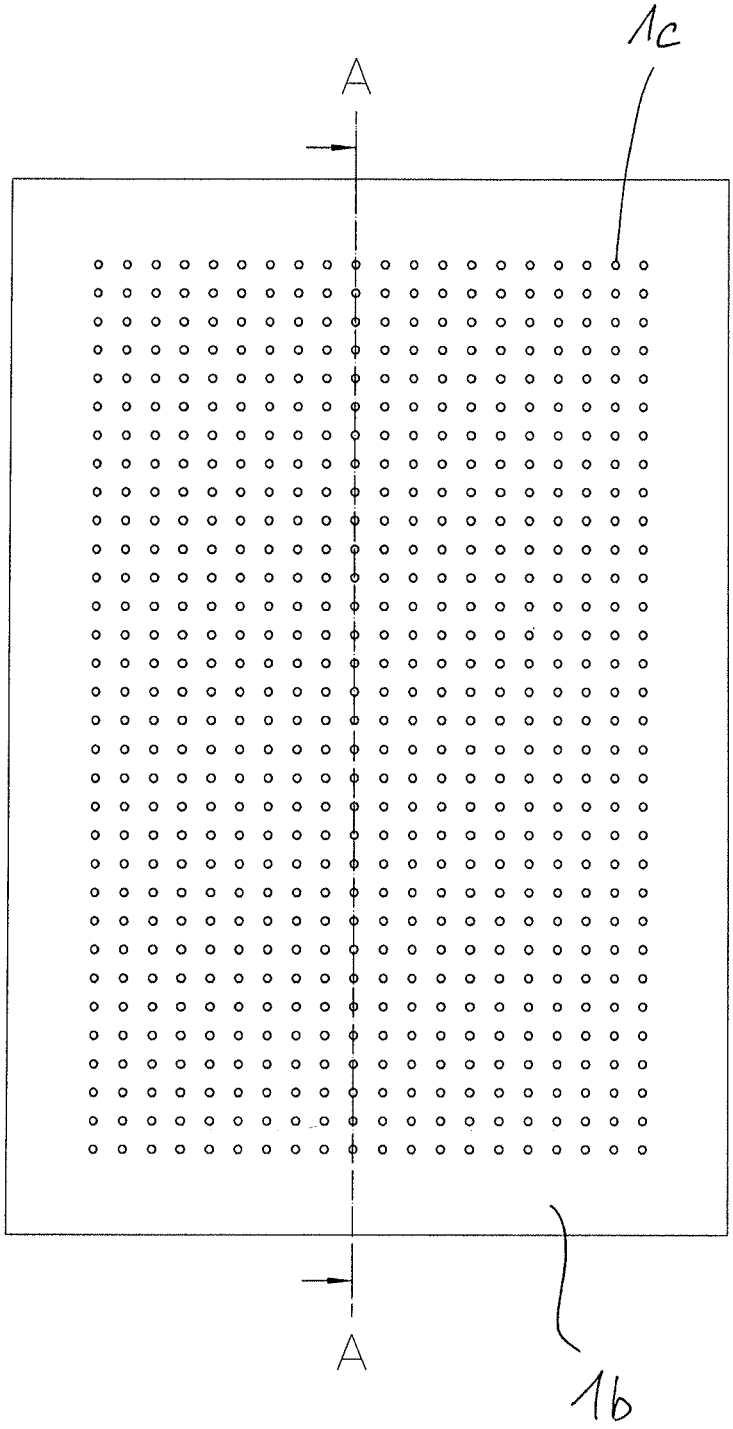
FIG. 1B shows a top view of an exemplary acoustic element according to the invention.
Figure 1C:
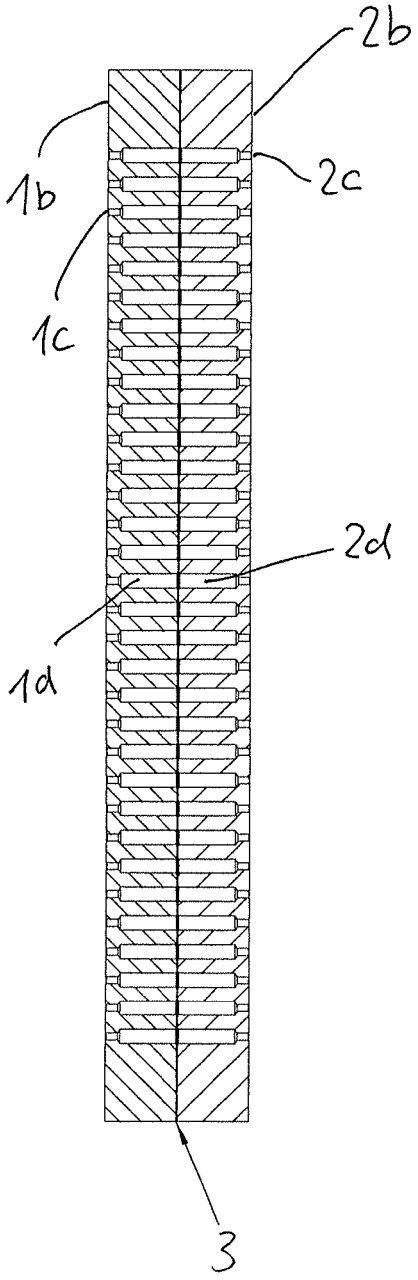
FIG. 1C shows a schematic presentation of an exemplary acoustic element according to the invention.
Figure 2A:
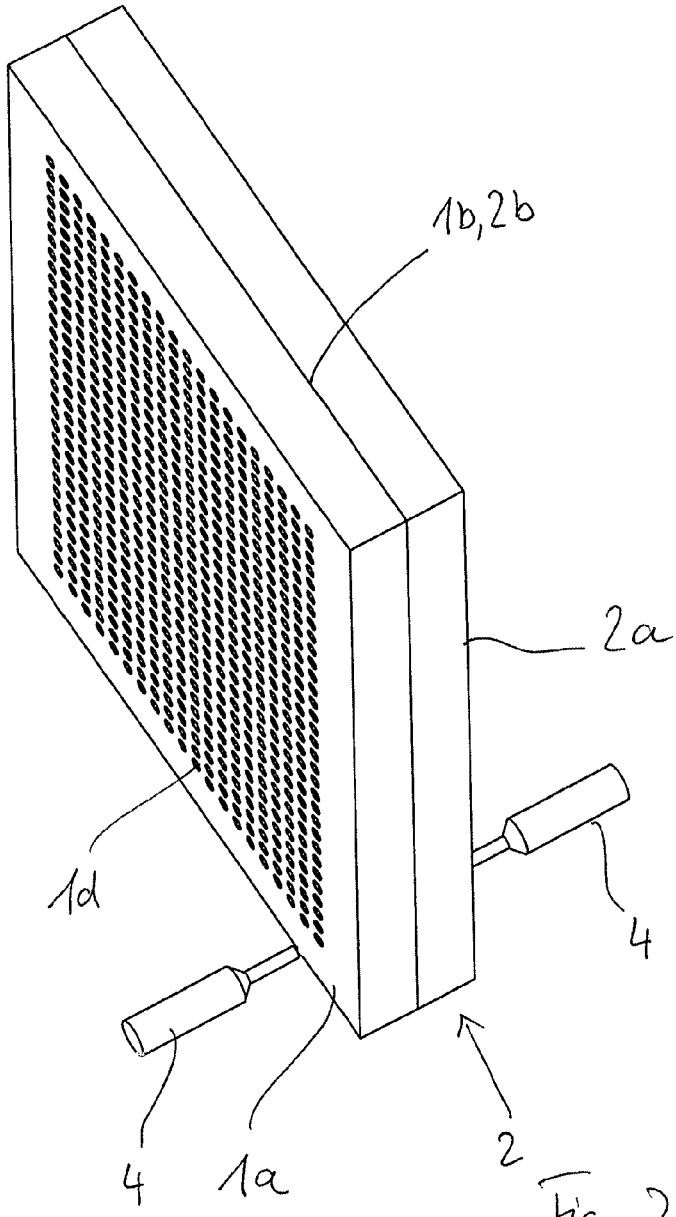
FIG. 2A shows an exemplary acoustic element according to the invention while performing the method according to the invention in the arrangement of the board-shaped elements intended for the drilling of the holes.
Figure 2B:
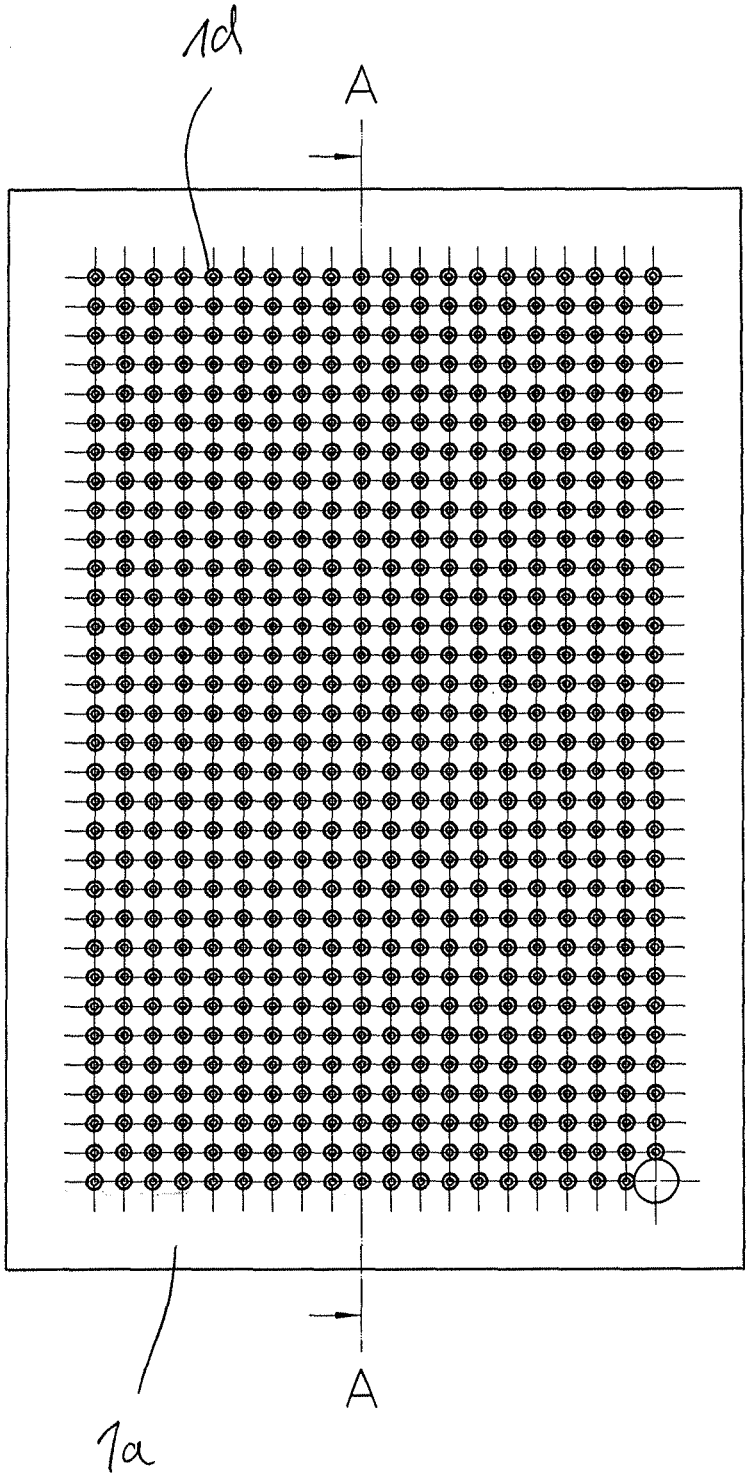
FIG. 2B shows a top view of the acoustic element of FIG. 2C.
Figure 2C:
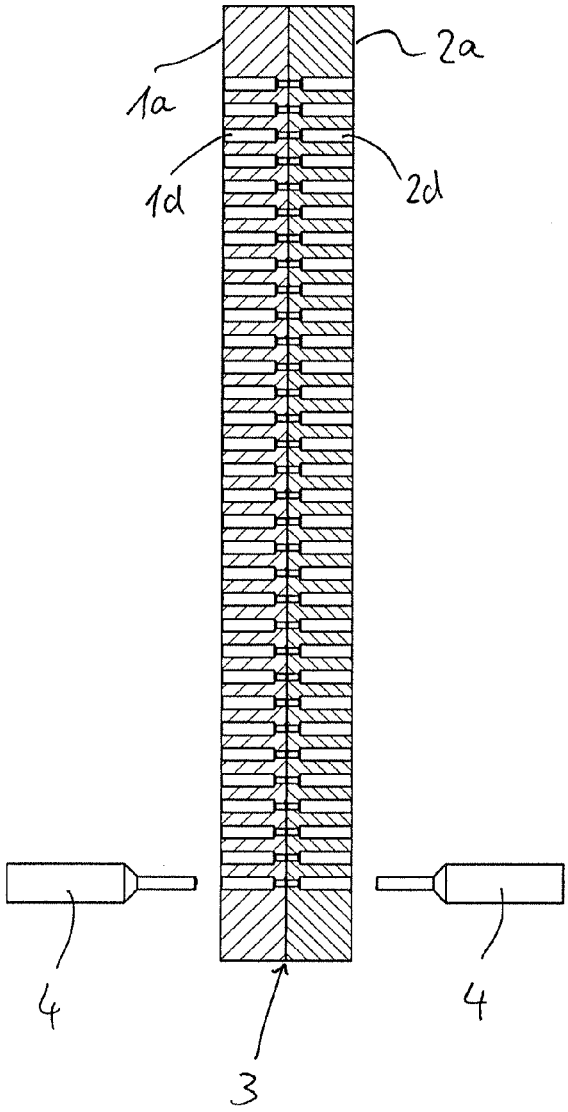
FIG. 2C shows a cross-sectional presentation of an exemplary acoustic element according to the invention in the arrangement of the board-shaped elements intended for the drilling of the holes.
Figure 3:
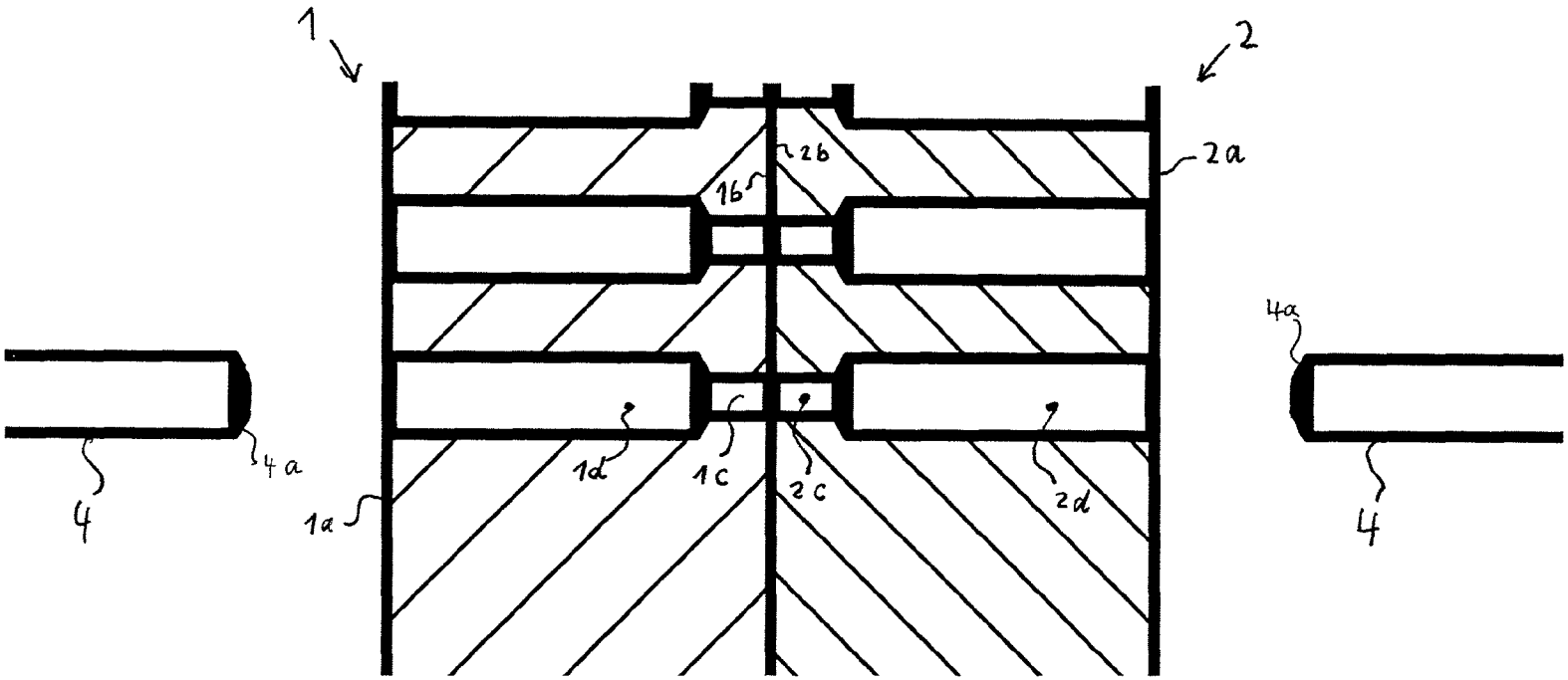
FIG. 3 shows a magnified presentation of a section of FIG. 2C.

The exemplary acoustic element according to the invention consists of the board-shaped elements 1 and 2 and the dampening element 3. The dampening element 3 is arranged between the joining areas 1*a* and 2*a* of the board-shaped elements 1 and 2. The holes in the board-shaped elements 1 and 2 are designed as stepped holes with two diameters, where the sections 1*d* and 2*d* with the larger diameters point towards the joining areas 1*a* and 2*a* and sections 1*c* and 2*c* with the smaller diameters point towards the surfaces 1*b* and 2*b* of the acoustic element.

During production, the board-shaped elements 1 and 2 are arranged such that the surfaces 1*b* and 2*b* intended as the external surfaces of the acoustic element are placed together and the joining areas 1*a* and 2*a* of the acoustic element point outward in the finished arrangement. In this arrangement, the holes are generated using the drilling equipment 4; in the example, only the drilling tools for the holes with the larger diameters 1*d* and 2*d* are shown. In the shown case, the resulting stepped holes exhibit conical transition surfaces in the area of their step, i.e., in the transition between sections 1*d* and 1*c*, or 2*d* and 2*c*, respectively. Typically, such transitional areas are technically due to the design of the cutting surface of the drill bit at the front in the area 4*a* and as already mentioned do not change the character of the bore hole as stepped holes.

Modifications and substitutions by one of ordinary skill in the art are considered to be within the scope of the present invention, which is no to be limited except by the following claims.

The invention claimed is:

1. An acoustic element having at least two plate-like elements (1, 2) each of which have a plurality of bores (1*c*, 1*d*, 2*c*, 2*d*), said at least two plate-like elements configured for being joined together at confronting joining faces of each of said at least two plate-like elements, characterised in that the plurality of bores (1*c*, 1*d*, 2*c*, 2*d*) of at least one plate-like element (1, 2) each have at least two different diameters and are arranged so that one section (1*c*, 2*c*) with the smaller diameter of the relevant bore faces an outside surface (1*b*, 2*b*) of the acoustic element and one section (1*d*, 2*d*) of the bore with the larger diameter points towards the confronting joining faces (1*a*, 2*a*) of the at least two plate-like elements, and wherein the bores (1*c*, 1*d*, 2*c*, 2*d*) are designed as stepped bores.

2. The acoustic element according to claim 1 further including an insulating fleece element (3) is placed between the confronting joining faces (1*a*, 2*a*) of the at least two plate-like elements (1, 2).

3. The acoustic element according to claim 1 characterised in that the sections (1*c*, 2*c*) of the plurality of bores (1*c*, 1*d*, 2*c*, 2*d*) having the smaller diameter of the relevant bores each have a diameter of no greater than 3 mm.

4. The acoustic element according to claim 1 wherein bores (1*c*, 1*d*, 2*c*, 2*d*) of different plate-like elements (1, 2) joined to one another are arranged aligned and coaxial with one another.

5. The acoustic element according to claim 1 characterised in that the plate-like elements (1, 2) are glued to one another.

6. A method for manufacturing the acoustic element of claim 1, comprising the following method steps:

arranging said at least two plate-like elements (1, 2) into one composite unit element so that at least one surface (1*b*, 2*b*) of each of said at least two plate-like elements (1, 2) comes into contact with another plate-like element; creating the plurality of bores (1*c*, 1*d*, 2*c*, 2*d*), wherein the plurality of bores are designed as stepped bores; and rearranging the plate-like elements (1, 2) into the arrangement intended for a finished acoustic element wherein at least one joining surface area (1*b*, 2*b*) of the previous arrangement becomes an outer surface in the arrangement intended for the finished acoustic element.

7. The method according to claim 6 characterised in that the plate-like elements (1, 2) when rearranged into the arrangement intended for the finished acoustic element are joined together.

8. The method according to claim 7 further including after the step of creating the plurality of bores and before the step of joining the rearranged plate-like elements the step of placing at least one insulating fleece element (3) between said two plate-like elements (1, 2).

* * * * *